US011198166B2

(12) United States Patent
Mazzocchi

(10) Patent No.: US 11,198,166 B2
(45) Date of Patent: Dec. 14, 2021

(54) ADJUSTABLE DIE FOR A PRESS BRAKE

(71) Applicant: ROLLERI S.P.A., Vigolzone (IT)

(72) Inventor: Domenico Mazzocchi, Vigolzone (IT)

(73) Assignee: ROLLERI S.P.A., Vigolzone (IT)

( * ) Notice: Subject to any disclaimer, the term of this patent is extended or adjusted under 35 U.S.C. 154(b) by 326 days.

(21) Appl. No.: 16/339,847

(22) PCT Filed: Oct. 19, 2017

(86) PCT No.: PCT/IB2017/056504
§ 371 (c)(1),
(2) Date: Apr. 5, 2019

(87) PCT Pub. No.: WO2018/073781
PCT Pub. Date: Apr. 26, 2018

(65) Prior Publication Data

US 2020/0047235 A1 Feb. 13, 2020

(30) Foreign Application Priority Data

Oct. 21, 2016 (IT) ..... 102016000106455
May 16, 2017 (IT) ..... 102017000052717

(51) Int. Cl.
*B21D 5/02* (2006.01)
*B21D 5/01* (2006.01)
(Continued)

(52) U.S. Cl.
CPC ..... *B21D 5/0227* (2013.01); *B21D 5/01* (2013.01); *B21D 3/10* (2013.01); *B21D 5/06* (2013.01); *B21D 37/02* (2013.01); *B30B 15/0035* (2013.01)

(58) Field of Classification Search
CPC ..... B21D 5/0227; B21D 5/01; B21D 3/10; B21D 5/06; B21D 37/02; B21D 5/0209;
(Continued)

(56) References Cited

U.S. PATENT DOCUMENTS 4,366,698 A 1/1983 Gill
5,022,248 A 6/1991 Brooks et al.
(Continued)

FOREIGN PATENT DOCUMENTS

SU 496 072 A1 12/1975

OTHER PUBLICATIONS

International Search Report, dated Dec. 22, 2017, from corresponding PCT/IB2017/056504 application.

*Primary Examiner* — Adam J Eiseman
*Assistant Examiner* — Amer Islam
(74) *Attorney, Agent, or Firm* — Nixon & Vanderhye

(57) ABSTRACT

Disclosed is a die for a press brake including a base, a first half portion and a second half portion of a mold, each including a plurality of plates parallel to one another and alternated in a longitudinal direction of the die, the die including a translation device to move the half portions away from and toward each other, the device including a plurality of guides obtained on the plates, a shaft slidingly engaged with the guides, a first pinion and a second pinion mounted on the shaft and at least a first rack and at least a second rack respectively on a first plate of the first half portion and on a second plate of the second half portion and meshed respectively with the first and second pinion.

20 Claims, 8 Drawing Sheets

(51) Int. Cl.

| | |
|---|---|
| *B21D 3/10* | (2006.01) |
| *B21D 5/06* | (2006.01) |
| *B21D 37/02* | (2006.01) |
| *B30B 15/00* | (2006.01) |

(58) Field of Classification Search
CPC ..... B21D 5/02; B21D 5/0027; B21D 37/04; B30B 15/0035; B30B 11/02; B30B 11/04; B30B 11/12; B30B 11/14; B29C 33/308
See application file for complete search history.

(56) References Cited

U.S. PATENT DOCUMENTS

| | | | | |
|---|---|---|---|---|
| 5,249,452 | A | 10/1993 | Baldwin et al. | |
| 5,295,384 | A * | 3/1994 | Schubert | B21D 5/02 72/383 |
| 7,117,711 | B2 | 10/2006 | Feijen | |
| 2005/0011247 | A1 * | 1/2005 | Jacobsen | B21D 5/0209 72/389.8 |
| 2008/0098793 | A1 * | 5/2008 | Rogers | B21D 5/0209 72/482.2 |
| 2009/0100896 | A1 * | 4/2009 | Akami | B21D 5/02 72/389.4 |

* cited by examiner

ADJUSTABLE DIE FOR A PRESS BRAKE

BACKGROUND OF THE INVENTION

Field of the Invention

The present invention concerns an adjustable die usable in a press brake to deform, by means of bending, sheet-like elements such metal plate or the like.

In particular, the present invention relates to an adjustable die comprising two parts that can be moved in relation to each other to allow bending of a sheet with different bending angles or radii.

Description of the Related Art

As is known, bending presses are equipped with a punch, moved by hydraulic actuators, adapted to press a sheet-like workpiece, usually a metal plate, against a die. This die has a seat typically, but not necessarily, defined by a V-shaped notch.

In the idle position, the punch is spaced from the die to allow a metal plate to be bent to be inserted between the punch and the die. In the working position, the lower end of the punch is carried toward the seat of the die, so as to press the metal plate arranged between the two aforesaid elements, bending it. As a function of the thickness of the metal plate to be bent, of the bending angle and of the material of the metal plate, the press must be equipped with a die having a given shape and size of the seat.

In many cases, dies of fixed type are used, i.e., with one or more seats having a defined shape and size. As a function of the bending parameters, the press is equipped with a die having the correct shape and size.

However, these fixed dies are not very practical when carrying out operations that require frequent variations in the bending parameters and, therefore, required numerous changes or repositionings of the suitable die in the press.

These operations involve large amounts of time, as well as the difficulty of handling the dies which, in some cases, can weight several tens of kilograms.

There are also known in the sector adjustable dies formed of two half portions that can be moved toward or away from each other and clamped in the related selected position to vary the bending radius of the metal plate to be worked.

Each of the two half portions has an edge on which the metal plate rests during bending. By moving the two half portions away from each other, the edges also move away from each other leaving between them a free space in which the lower end of the bent portion of the metal plate is positioned.

Examples of dies such as those described above are shown in U.S. Pat. Nos. 4,366,698 A and 7,117,711 B2.

However, these documents do not describe a system for moving the two half portions of the die between different clamping positions. This operation can, in some cases, be carried out manually by the operator who controls the press. However, when the length of the die is quite considerable, for example two meters or greater, the weight of the half portions is such as to require several people to move and reposition them.

U.S. Pat. Nos. 5,249,452 A and 5,022,248 A illustrate adjustable dies in which the two half portions can be moved in relation to each other, respectively by means of a lead screw drive device and by means of hydraulic actuators.

Although functional, these systems are particularly complicated and costly to produce and can therefore only be advantageously applied to dies of large size.

BRIEF SUMMARY OF THE INVENTION

In this context, the object of the present invention is to propose an adjustable die that overcomes the limits of the prior art cited above.

Therefore, the object of the present invention is to propose an adjustable die in which the two half portions can be moved practically and rapidly.

Another object of the present invention is to produce die that is inexpensive and easy to produce.

Another object of the present invention is to provide a sturdy adjustable die that does not require periodic maintenance or overhaul operations.

Yet another object of the present invention is to provide an adjustable die equipped with a stable and precise clamping system of the position of the two half portions.

A further object of the present invention is to provide an adjustable die equipped with a clamping system of the half portions that is practical and rapidly activated.

One more object of the present invention is to propose a die equipped with a clamping system that is inexpensive and easy to produce.

These objects are achieved by an adjustable die in which the two half portions of the mold, which can move away from and toward each other, each comprise a plurality of plates parallel, to and integral with one another. The plates of each half portion are positioned at a distance from one another such as to respectively accommodate between them at least one part of a plate of the opposite half portion. This configuration enables the plates to mutually penetrate, allowing the width of the mold cavity comprised between them to be varied. According to the invention, the die is provided with a translation device of the two half portions of the rack type. More specifically, the device comprises a shaft on which at least one, or preferably two, pinions are mounted to mesh with one or more racks connected to the first plates and to the second plates. Guides obtained in the plates engage the aforesaid shaft and ensure that, following rotation, the two half portions are moved away from or toward each other. The shaft can be manually operated, for example through a handwheel, a lever or the like, or by an electric or pneumatic actuator, for example an electric motor.

The die configured in this way therefore allows rapid repositioning of the two half portions to vary the size of the mold cavity as a function of the thickness of the metal plate to be bent and of the bending radius.

The limited number of parts of the translation device and their mechanical simplicity make the die sturdy, and therefore not prone to faults or breakages, and relatively inexpensive to produce compared to adjustable dies of the prior art.

The subject matter of the present invention is therefore a die comprising:

- a base;
- a first half portion and a second half portion of a mold, resting sliding on said base, between which the mold cavity is defined.

In the die the first half portion comprises a plurality of first plates parallel to one another and the second half portion comprises a plurality of second plates parallel to one another. Said first and second plates extend in a transverse direction in the die, and are alternated in a longitudinal direction of the die. The first plates are positioned at a distance from one another such as to accommodate, between two consecutive first plates, at least a part of a second plate, and the second plates are positioned at a distance from one another such as to accommodate, between two consecutive second plates, at least a part of a first plate. The die further comprises a translation device to move the first half portion and the second half portion away from and toward each other so as to vary the width of the mold cavity. This device comprises:

- a plurality of first guides obtained on the first plates and a plurality of second guides obtained on the second plates;
- a shaft arranged along a longitudinal direction of the die and engaged with the first guides and with the second guides so as to slide along said first guides and said second guides when the first half portion and the second half portion are moved away from or toward each other;
- at least a first pinion and a second pinion mounted on said shaft;
- at least a first rack and at least a second rack respectively on a first plate and on a second plate.

The aforesaid first and second racks are meshed with said first and second pinions so that following rotation of the shaft in one direction or in the opposite direction, the two half portions are moved away from or toward each other.

According to an aspect of the invention, the first guides and the second guides can comprise slots, obtained respectively in the first plates and in the second plates, in which the shaft can slide freely. Preferably, said slots extend rectilinearly and have a substantially constant width.

According to a preferred aspect of the invention, the directions of sliding of the shaft, respectively in the first guides and in the second guides, are inclined and mutually convergent. In practice, the slots are not arranged parallel to the direction of sliding of the half portions on the base but, on the contrary, are inclined with a direction descending toward the center of the die.

This arrangement is particularly effective to reduce the size, and therefore the weight, of the plates with the same size of mold cavity.

More in detail, the aforesaid arrangement allows a reduction in the height of the end portions of the plates, which do not affect the shape or size of the cavity, but which are nonetheless required for the stability of the half portions.

Preferably, the aforesaid directions of sliding delimit between them an angle comprised between 100° and 130°. Said angle is preferably around 110°.

To obtain a symmetrical movement of the half portions, the aforesaid directions are symmetrical with respect to the centerline axis of the die, i.e., the angle between each of the aforesaid directions and said centerline axis is the same.

According to another aspect of the invention, the die can comprise further guide means of the shaft configured to guide the shaft along a direction substantially vertical or in any case perpendicular to the direction of sliding of the half portions of the mold on the base.

Again, for the purpose of obtaining symmetrical movement of the half portions, these guide means are preferably arranged so that the aforesaid direction of sliding of the shaft passes through the centerline axis of the die. In this way, the center of the mold cavity is always aligned on said centerline and, therefore, aligned with the bending punch.

According to another aspect of the invention, the first rack and the second rack are arranged substantially parallel to said directions of sliding of the first guides and of the second guides.

According to yet another aspect of the invention, the first rack and the second rack are arranged at opposite edges of the slot, respectively of a first guide and of a second guide. This arrangement allows, following a rotation of the shaft, the two half portions to be moved in opposite directions, i.e., toward or away from each other.

According to another aspect of the invention, the die can comprise a clamping system to clamp the first half portion and the second half portion in one or more specific positions.

This clamping system can be used on an adjustable die equipped with the movement system of the half portions of the present invention, described above, or alternatively, also with any other known movement system, automatic or optionally even completely manual.

In this second case, the adjustable die can therefore comprise a base, a first and a second half portion of a mold, resting sliding on said base, between which the mold cavity is defined. The first half portion comprises a plurality of first plates parallel to one another and the second half portion comprises a plurality of second plates parallel to one another. Said first and second plates extend in a transverse direction in the die, and are alternated in a longitudinal direction of the die. The first plates are positioned at a distance from one another such as to accommodate, between two consecutive first plates, at least a part of a second plate, and the second plates are positioned at a distance from one another such as to accommodate, between two consecutive second plates, at least a part of a first plate.

The die further comprises a clamping system of the half portions according to the variants described below.

According to a first variant, said clamping system can comprise at least one seat for housing a clamping rod, which extends along a longitudinal direction of the die. The seat comprises at least one lower portion, obtained in the base, and upper portions, obtained in the first plates and in the second plates. Said lower and upper portions of the seat define the aforesaid seat when they are substantially aligned with each other in a specific position of the two half portions of the mold. In other words, when the aforesaid lower and upper portions of the seat are aligned along a common direction they allow sliding housing of the clamping rod. The shape of the seat is such as to prevent mutual sliding of the half portions of the mold during the bending operation.

The same die can therefore offer a range of "opening" positions, each of which corresponds to a given width of the mold cavity to bend metal plates with different thicknesses and bending radii.

Advantageously, the clamping rod can comprise a profile, solid or tubular, provided with a plurality of transverse notches in the upper part. Said notches are arranged in series with a pitch equal to approximately half the distance between a first plate or a second plate and an adjacent plate. Furthermore, said notches have a width at least equal to, or slightly greater than, the thickness of said first plates and said second plates.

This structure of the clamping rod allows the die to be taken from a condition clamped in a specific opening position, to a released condition, in which the two half portions can be moved away from or toward each other, moving the clamping rod for a short distance along its axis.

In practice, it is sufficient to take the rod to a position in which all the first and second plates are aligned with the notches in the upper part. In this way, the aforesaid plates can slide freely on the base passing through the clamping rod at said notches.

According to another preferred variant of the invention, the clamping system can comprise a plurality of grooves obtained on the upper surface of the base and one or more clamping teeth, obtained on the lower surface of one or more of the first plates and of the second plates.

Each clamping tooth is adapted to house one of the aforesaid grooves when the lower surface of the half portions is resting on the upper surface of the base.

The shape of the groove and of the clamping teeth is such as to prevent the translation of the two half portions with respect to the base, at least in a direction away from each other and optionally also in a direction toward each other.

When the teeth are engaged in the grooves, the half portions of the die are therefore able to withstand the forces generated during bending, forces that would tend to move the aforesaid parts away from each other.

The clamping system further comprises a lifting system adapted to lift the two half portions in order to disengage the clamping teeth from the grooves so that the half portions can be moved toward or away from each other.

In this condition the two half portions can be moved toward or away from each other as a function of the bending operation to be carried out.

After reaching the chosen position, the lifting system lowers the half portions again so that the respective clamping teeth engage the corresponding grooves in the base.

The grooves preferably extend parallel to the longitudinal direction of the die. Said grooves are preferably continuous and have a section of constant size.

Said grooves can be obtained only at the respective clamping teeth of the half portions or, preferably, can extend for substantially the whole length of the base.

According to an aspect of the invention, said lifting system comprises a joint interposed between two consecutive plates of the first half portion and of the second half portion.

As a function of the length and of the weight thereof, the die can comprise more than one of said joints that serves each half portion, for example two, three or more.

According to a preferred embodiment, said joint comprises at least one rocking guide that can oscillate between an idle position, in which it does not engage the half portion, and a raised position, in which it engages a gauge integral with at least one plate of the half portion to lift it.

The oscillating movement is obtained, for example, by hinging said rocking guide on at least one plate of the half portion.

Advantageously, according to the invention, the gauge can comprise a rolling means. In this way, when the rocking guide is in the lifting position, said rolling element can slide freely thereon allowing easy movement of the half portion with respect to the base and with respect to the facing half portion.

According to an aspect of the invention, the lifting system can comprise at least one actuator connected to the rocking guide adapted to move it between the aforesaid idle and lifting positions. Said actuator can be housed in the base and is equipped with an active moving part that projects from the upper surface of the base toward the rocking guide.

Typically, each rocking guide is served by an actuator.

Typically, said actuator can be a pneumatic or hydraulic cylinder, an electric linear actuator or an electromagnet. According to another aspect of the invention, the die comprises constraining means adapted to prevent vertical movements of the half portions and, more precisely, inclinations thereof with respect to the base.

Said constraining means according to the invention comprise a pair of brackets constrained to the base, each adapted to engage an end part of one or more plates of a half portion and to maintain it substantially resting on the base.

According to a preferred variant, said brackets comprise a sheet, arranged at a respective lateral edge of the base, said sheet having a plurality of openings having a width substantially equal to that of the end part of the plates. Moreover, said openings have an abutting edge adapted to slidingly engage the upper side of said end part.

BRIEF DESCRIPTION OF THE DRAWINGS

Further characteristics and advantages of the present invention will become more apparent from the description of an example of a preferred, but not exclusive, embodiment of an adjustable die for a press brake, as illustrated in the accompanying figures, wherein.

DETAILED DESCRIPTION OF THE PREFERRED EMBODIMENTS

With reference to the accompanying figures, an adjustable die for press brakes according to the present invention is indicated as a whole with the number 1.

Figure 1:
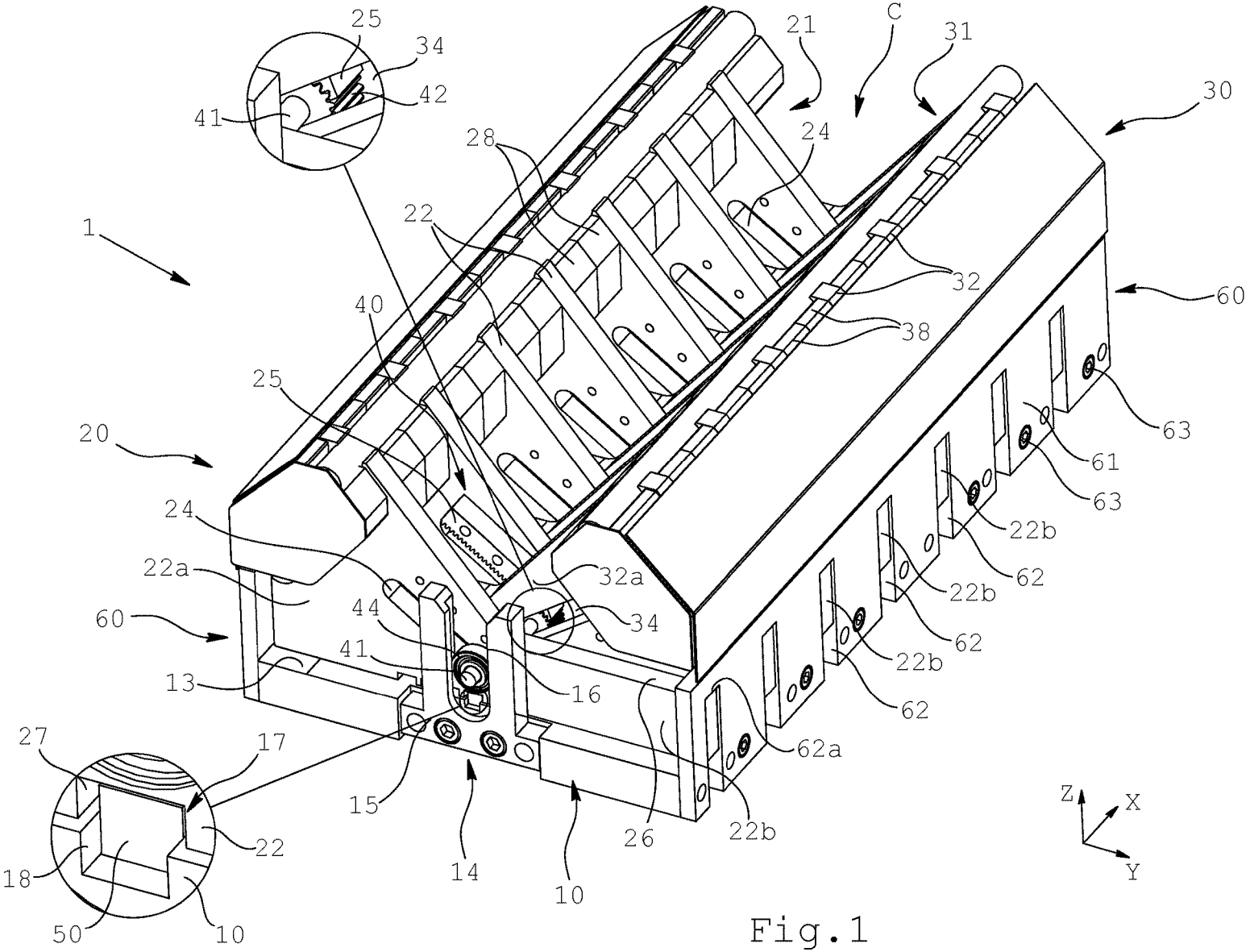
FIG. 1 is a perspective view of the adjustable die according to the invention.
Figure 2:
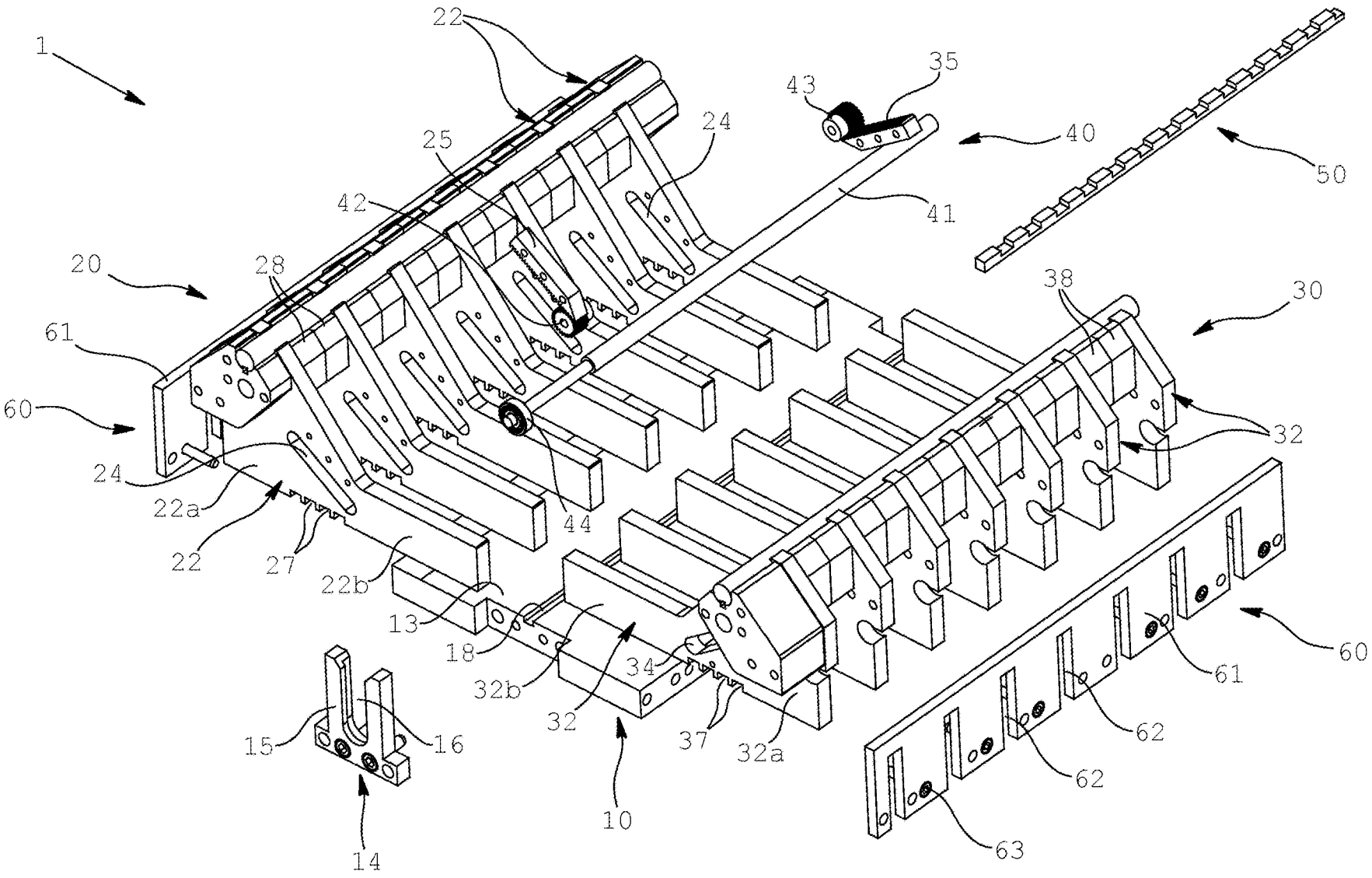
FIG. 2 is an exploded perspective view of the die of FIG. 1.
Figure 3:
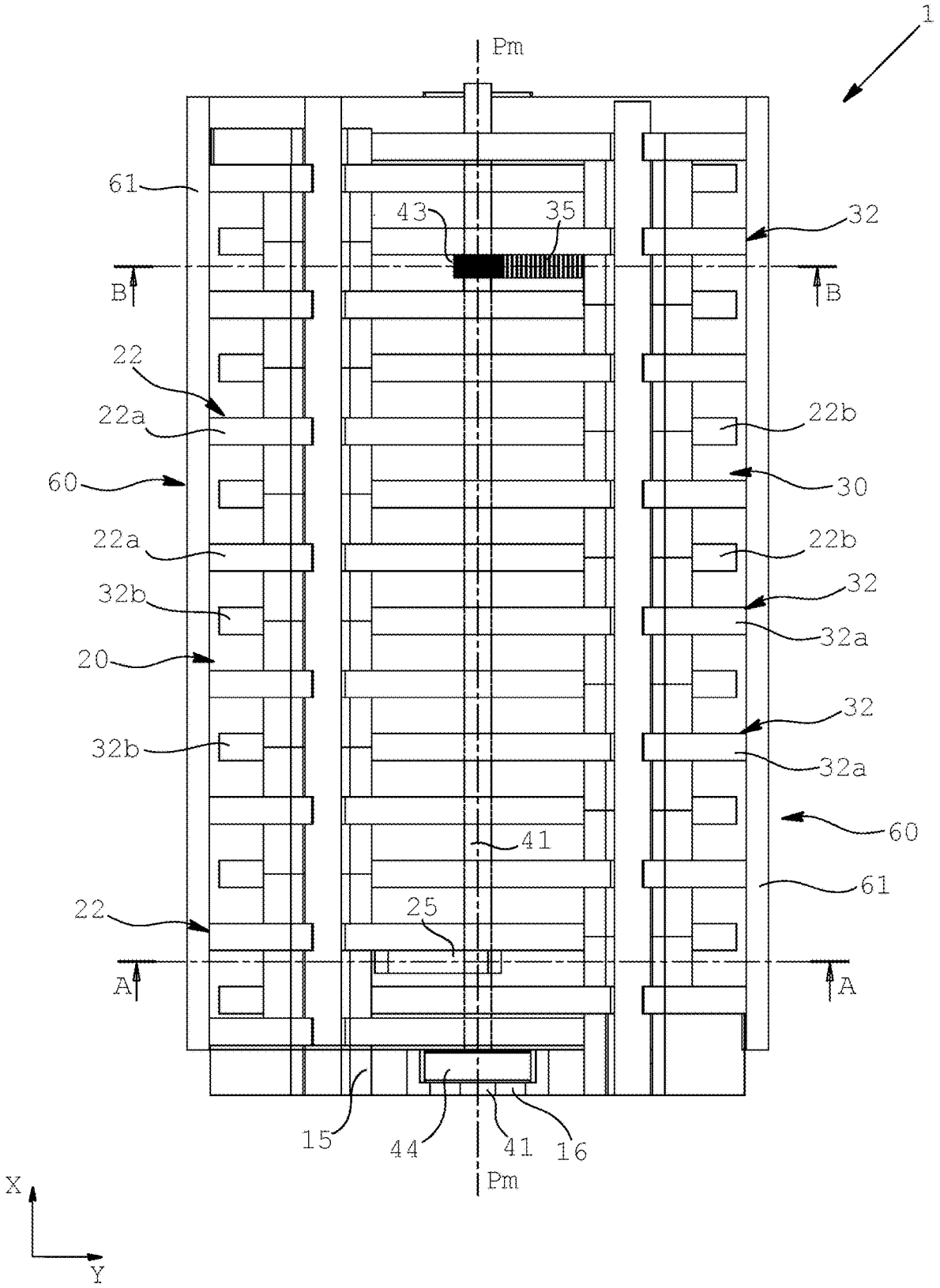
FIG. 3 is a plan view of the die of FIG. 1.
Figure 4:
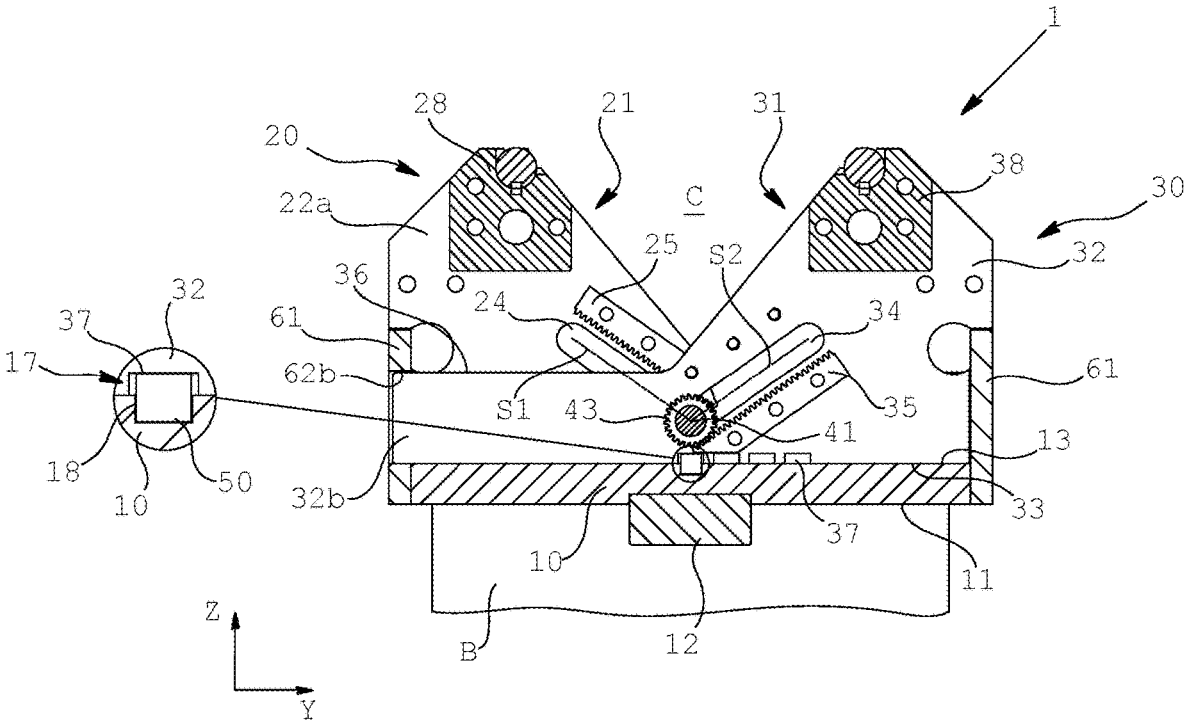
FIG. 4 is a cross sectional view along a transverse plane A-A of the die of FIG. 3.
Figure 5:
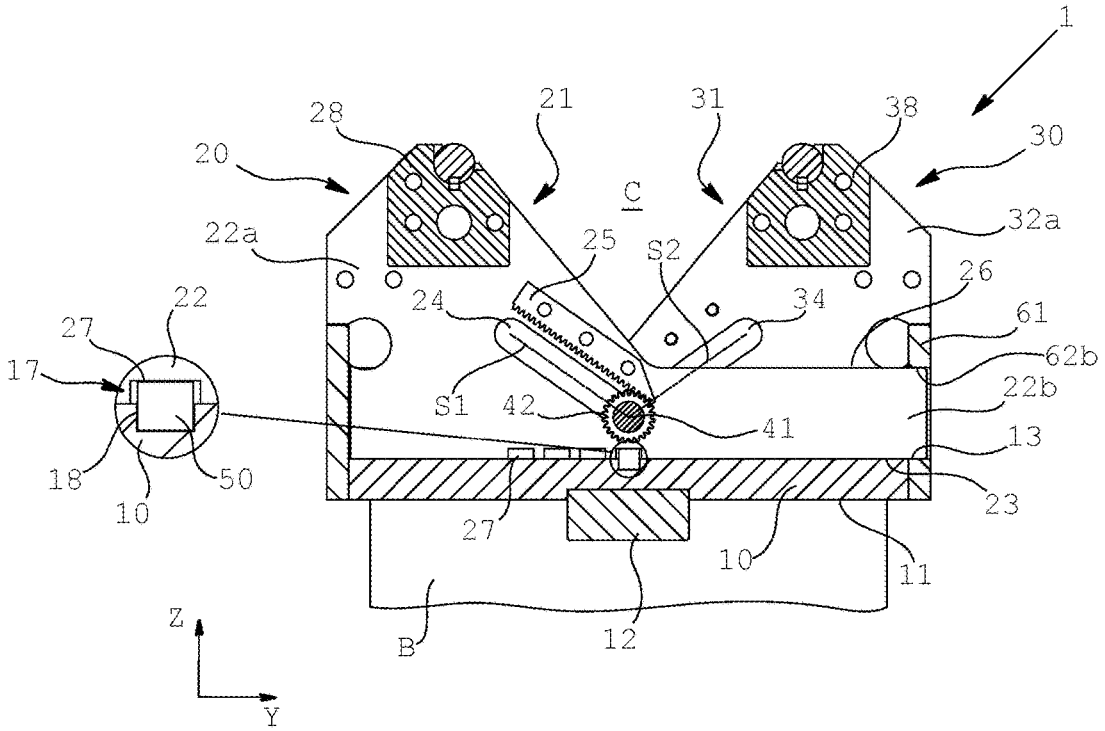
FIG. 5 is a cross sectional view along a transverse plane B-B of the die of FIG. 3.

The adjustable die 1 can be installed on a press brake, know per se and therefore not illustrated, said press comprising a bed, a lower beam B (FIGS. 4, 5) installed on the bed, an upper beam mounted above the lower beam B and actuators, for example hydraulic, adapted to impart a vertical movement to the upper beam toward or away from the lower beam B. Punches (not shown in the figure) can be removably installed on the upper beam.

The adjustable die 1 comprises a supporting base 10 preferably defined by a single block of metal, typically steel. According to a preferred variant, the base 10 is in the form of sheet or plate of substantially constant thickness. The base therefore has a flat lower face 11, which rests on the lower beam B and an upper face, and optionally a projecting tail 12 that allows the die to be correctly positioned on the lower beam B. The base also has a prevalently flat upper surface 13 on which a first half portion of mold 20 and a second half portion of mold 30, hereinafter also only "half portions", are received resting sliding thereon.

Between the aforesaid half portions 20, 30 there is defined a mold cavity C in which part of the metal plate bent during bending is received. More in detail, said cavity C is laterally delimited by two faces 21, 31 respectively of the first half portion 20 and of the second half portion 30. In the variant illustrated, the faces 21, 31 are inclined and convergent giving the cavity a V-shaped profile. The angle comprised between the aforesaid faces 21, 31 is typically of around 90°. Moreover, the aforesaid faces are preferably arranged symmetrically with respect to the centerline plane Pm of the die. However, the faces 21, 31 can have a different shape and angular arrangement, for example they can be substantially normal to the upper surface 13 of the base 10.

The first and the second portion 20, 30 each respectively comprise a plurality of first plates 22 and of second plates 32, parallel to one another, which extend in a transverse direction Y of the die 1 and are arranged substantially perpendicular to the base 10. Having to withstand the thrust that the punch applies to the metal plate to deform it, the plates 22, 32 are generally made of steel or other metals with equivalent strength.

The distance between two adjacent first plates 22 is at least equal to or preferably greater than the thickness of each first plate 22. Similarly, the distance between two adjacent second plates 32 is at least equal to or preferably greater than the thickness of each second plate 32. This distance is defined and maintained by inserts 28, 38 interposed respectively between two plates 22, 32 and fixed thereto, for example by means of screws or the like. The purpose of said inserts 28, 38 is also that of increasing the rigidity of the half portions 20, 30 to withstand the high forces exerted by the metal plate on said half portions during bending.

In accordance with the invention, the first plates 22 and the second plates 32 are arranged alternated with each other along a longitudinal direction X of the die 1. In this way, the respective faces 21, 31 of the first half portion 20 and of the second half portion 30 are facing each other to form the mold cavity C. The plates 22, 32 have flat lower faces respectively 23, 33 resting sliding on the upper surface 13 of the base 10. The movement along the transverse direction Y of the half portions 20, 30, toward or away from each other, causes the variation of the width of the mold cavity C allowing the die 1 to support, during bending, metal plates of different widths or with different bending radii.

According to a preferred variant, the plates 22, 32 comprise higher central parts 22*a*, 32*a*, between which the cavity C is defined, and low end parts 22*b*, 32*b*, which extend toward the respective sides of the die. Preferably, said end portions 22*b*, 33*b* have a substantially constant height, i.e. have upper sides 26, 36 substantially parallel to the upper surface 13 of the base 10.

The die 1, in accordance with the invention, is provided with a translation device, indicated as a whole with 40, configured to impart to the half portions 20, 30 the aforesaid movement toward or away from each other.

The translation device 40 comprises a shaft 41, which extends along the longitudinal direction X of the die, and a plurality of first guides 24 and of second guides 34, obtained respectively on the first plates 22 and on the second plates 32, adapted to slidingly receive the shaft 41.

At least a first guide 24' and at least a second guide 34', respectively on a first plate 22' and on a second plate 32', are associated respectively with a first rack 25 and with a second rack 35. A first pinion 42, mounted on the shaft 41, meshes with the first rack 25, while a second pinion 43 meshes with the second rack 35.

According to the invention, the translation device is configured so that, following rotation of the shaft 41, the pinions 42, 43 drive the racks 25, 35 in opposite directions causing the movement of the relative plates 22', 34', and therefore of the half portions 20, 30, away from or toward each other.

According to a preferred variant, the guides 24, 34 comprise rectilinear slots, preferably of constant width. Typically, the width of the guides 24, 34 is more or less equal to the diameter of the shaft 41 or in any case of the portion of shaft 41 housed in the guide.

When the half portions 20, 30 move in relation to each other, the shaft 41 can slide, simultaneously, along the slots of the first guide and of the second guide.

To limit the size (in particular the modulus) of the pinions 42, 43 and of the racks 25, 35, the translation device preferably comprises at least two or more first pinions 42 and two or more second pinions 43. Advantageously, the pairs of first and second pinions are arranged homogeneously along the longitudinal direction X of the die.

In this way the thrust exerted on the plates 22, 32 is distributed in several points along the longitudinal direction, making the movement of the half portions 20, 30 fluid.

According to a preferred variant of the invention, the guides 24, 34, i.e., the directions of sliding S1, S2 of the shaft 41 (FIGS. 4, 5), are inclined and mutually converging. The angle comprised between the aforesaid directions S1, S2 is preferably comprised between 100° and 130° and more preferably is around 110°.

As mentioned above, this inclined arrangement of the guides 24, 34 allows the front surface, and therefore the weight, of each plate 22, 32 to be reduced.

More in detail, the arrangement of the guides indicated above allows the size of the plates to be limited in the lower part, where the lower sliding faces 23, 33 are obtained. In fact, this part has a greater width to the rest of the plate so as to give greater stability to the half portions. However, it is preferable to reduce the extension in height of this lower portion as much as possible, compatibly with the necessary mechanical strength, to limit the overall weight of the half portions 20, 30 and of the die 1.

According to the invention, the die 1 is equipped with further guide means 14 to guide the shaft 41 along a direction Z substantially perpendicular to the base 10 or in any case to the direction of movement of the half portions 20, 30.

In fact, the inclined arrangement of the guides 24, 34 ensures that during sliding along said guides, the shaft 41 is driven upward, when the half portions 20, 30 are moved toward each other, or downward, when the half portions 20, 30 are moved away from each other.

Said guide means comprise a bracket 15 integral with the base 10, in which there is obtained a slot 16 adapted to slidingly receive the shaft 41.

The slot 16 is aligned with the centerline plane Pm so as to maintain the shaft 41 aligned on said plane and allow the half portions 20, 30 to move symmetrically in relation to each other.

Advantageously, at the slot 16, the shaft 41 is provided with a bearing 44 to facilitate the movement of the shaft in the aforesaid slot 16.

The slot 16 is preferably open in the upper part to allow practical and fast installation or removal of the shaft 41.

According to the invention, the shaft 41 can be rotated manually or automatically. For example, the shaft 41 can be connected to a lever, to a flywheel or the like, or, alternatively, to an electric motor or to other electric or pneumatic actuators.

Figure 6A:
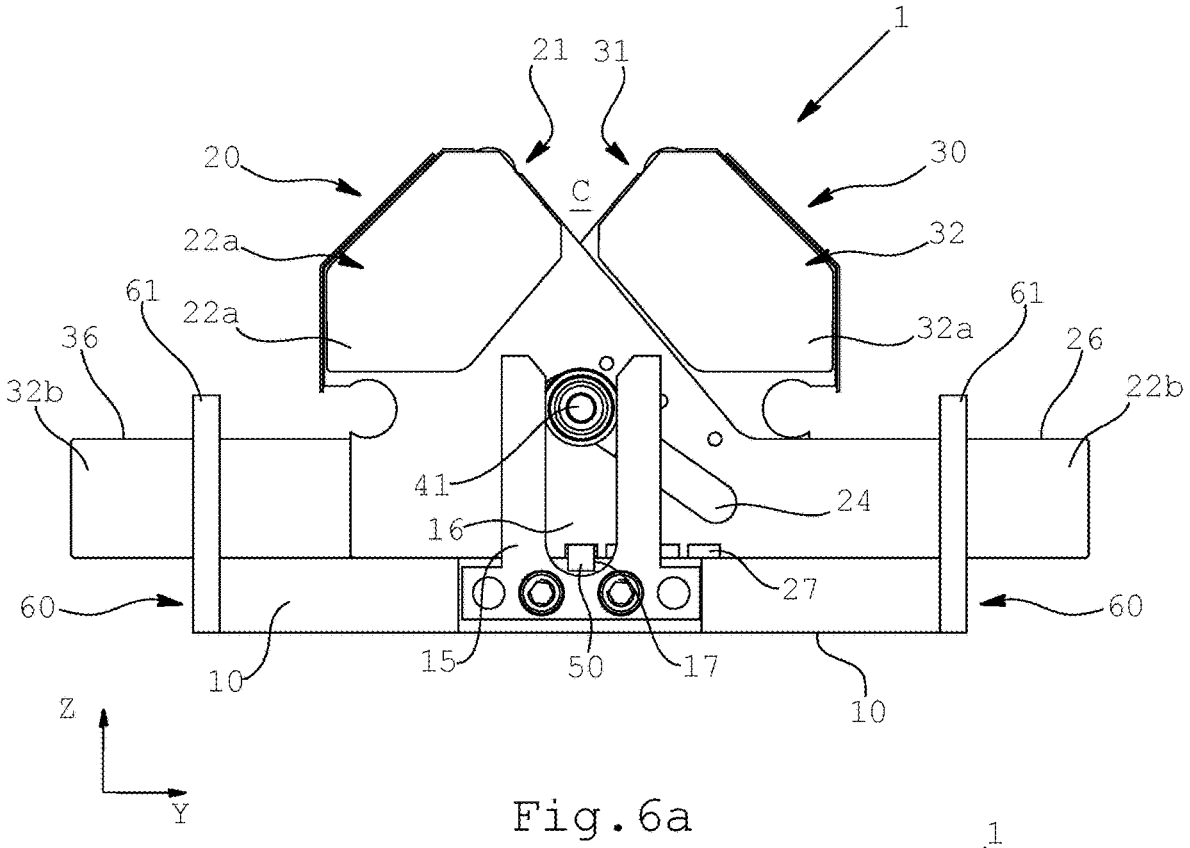
FIGS. 6*a* and 6*b* are front views of the die according to the invention, respectively with different opening positions of the two half portions.
Figure 6B:
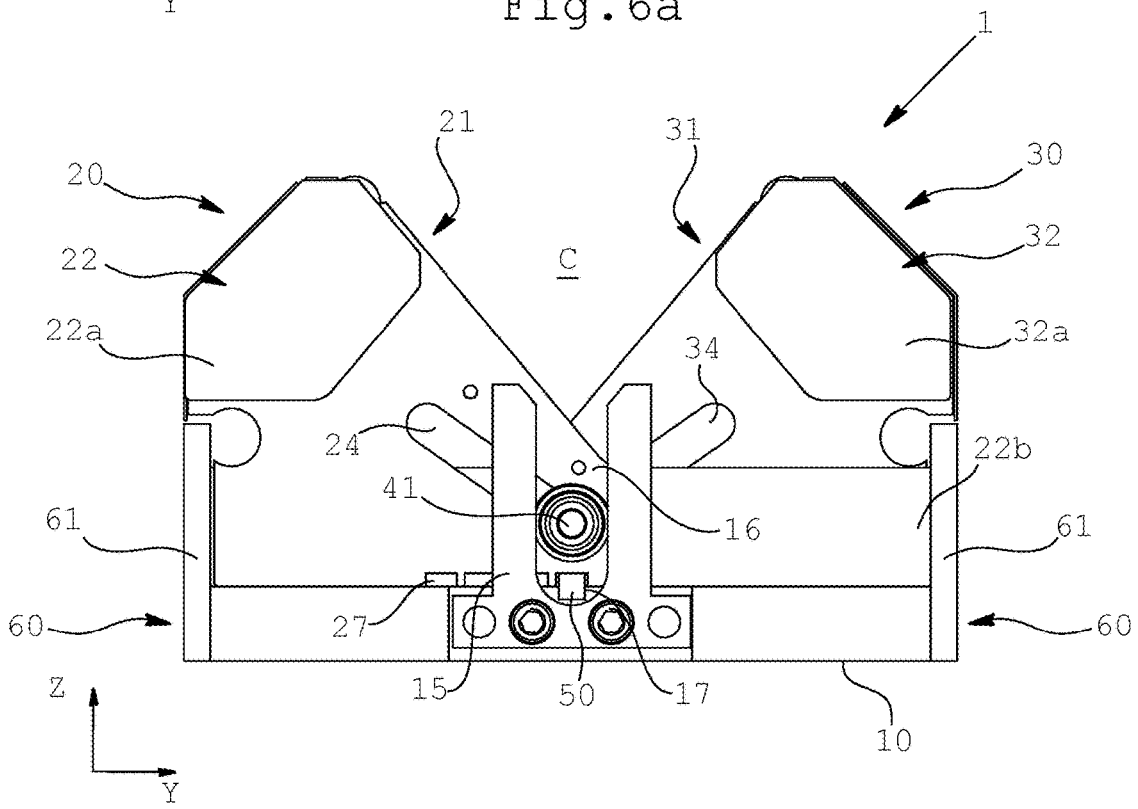

The translation device according to the invention therefore allows the relative position or "opening" of the two half portions 20, 30 to be varied, so as to be able to use the die for bending operations with different operating parameters, such as a different thickness of the metal plate or a different curvature radius. The accompanying FIGS. 6*a* and 6*b* illustrate the die according to the invention respectively in a minimum opening and a maximum opening position.

According to the invention, the die 1 can however be equipped with a clamping system to clamp the first half portion 20 and the second half portion 30 in the aforesaid minimum and maximum opening positions, as well as in one or more specific intermediate opening positions.

As already mentioned, according to the invention, this clamping system can be applied to an adjustable die equipped with the movement system of the two half portions described above or with any other movement system, known or unknown.

According to a first variant, said clamping system comprises at least one seat 17 for slidingly housing a clamping rod 50 that extends substantially parallel to the longitudinal direction X of the die.

The seat 17 comprises several portions, at least one lower and upper portions, which can face each other.

More in detail, a lower seat portion 18 is obtained on the upper surface 13 of the base 10. Said lower portion 18 typically has the shape of a groove that extends parallel to the longitudinal direction X of the die. This groove is preferably continuous and has a section of constant size.

The upper portions of the seat 17 comprise upper portions 27, obtained at the lower surface 23 of one or more first plates 22 and upper portions 37 obtained at the lower surface 33 of one or more second plates 32.

When the lower portion 18 and the upper portions 27, 37 are aligned with one another in the longitudinal direction of the die, they define the seat 17 in which the clamping rod 50 can slide.

Clamping of the plates 22, 32 with respect to the base 10 is guaranteed by the substantially complementary shape of the seat 17 and of the section of the clamping rod 50. Preferably, to facilitate sliding of the clamping rod 50, and prevent it from jamming between the plates 22, 32, the upper portions 27, 37 of seat have a slightly greater width than that of the clamping rod 50 and of the lower portion 18 of seat.

Figure 7:
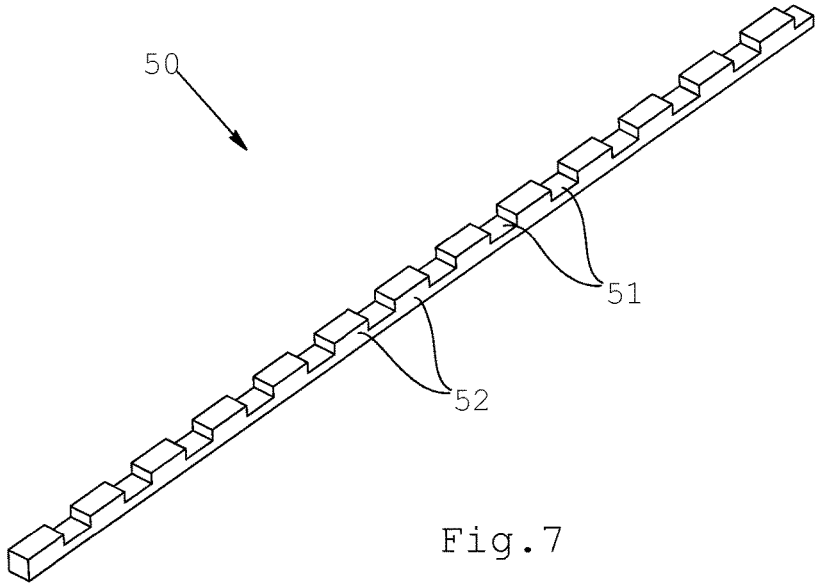
FIG. 7 is a perspective view of a part of the clamping system of the half portions.

According to a preferred embodiment, said clamping rod 50 comprises a profile, solid or tubular, provided with a plurality of transverse notches 51 in the upper part (FIG. 7). Said notches 51 are arranged in series and at a distance from one another with a pitch equal to around half the distance between a first plate 22, or a second plate 32, and an adjacent plate. The width of the notches 51 is instead at least equal to the thickness of said first and second plates 22, 32. Preferably, the lower edge 51*a* of said notches has a height that is lower than the depth of the lower portion 18 of the seat 17.

Between one notch 51 and an adjacent notch, the clamping rod 50 instead has portions 52 having a section of greater size or in any case with a greater height than the depth of the lower portion 18 of the seat 17.

When the clamping rod 50 is inserted in the seat 17, and the portions 52 are aligned with the upper portions 27, 37 of seat of the plates 22, 32, these latter can be clamped preventing the half portions 20, 30 from translating on the base 10.

To move the half portions 20, 30 away from or toward each other it is sufficient to slide the clamping rod 50 in the seat 17 so as to align the plates 22, 32 with the notches 52. In this position the plates 22, 32 can slide on the upper surface 13 of the base 10 passing freely through the clamping rod 50 through the notches 51.

According to a preferred variant of the invention, the clamping system comprises several upper portions of seat 27, 37 on the same plate 22, 32. For example, in each plate 22, 32 two or more upper portions 27, 37 of seat can be obtained. The aforesaid upper portions of seat are arranged so as to define several seats 17, i.e., several positions in which they are aligned with the lower portion 18 to house the clamping rod 50.

In this way, the die can have various clamping positions in different opening conditions of the half portions 20, 30. Therefore, the die allows bending of metal plates with substantially different thicknesses and bending radii to one another without having to remove and reposition different components on the press.

Optionally, also several lower portions 18 of seat can be obtained in the base 10 to increase the opening positions in which at least one seat portion 18 and upper portions 27, 37 are aligned.

The movement of the half portions 20, 30 between one opening (or clamping) position and another can take place simply and rapidly and without the use of tools or other instruments.

In the case in which the shaft 41 is connected to an electric motor, or in any case to an automatic drive, this latter can be associated with an electronic control configured to automatically position the half portions in the desired opening (or clamping) position.

FIGS. 8, 9 and 10*a* to 10*c* illustrate the die provided with a clamping system according to another preferred variant.

In this variant, a plurality of grooves 19 are obtained on the upper surface 13 of the base 10, parallel to one another and to the longitudinal direction X of the die. Said grooves 19 extend for a part of or, preferably, for the whole of the length of the base 10.

One or more clamping teeth 29, 39 are obtained at the lower surface 23, 33 of at least one, of several or of all the first plates 22 and the second plates 32.

In a clamping position of the half portions 20, 30, when the lower surface 23, 33 of the half portions is resting on the upper surface 13 of the base 10, the clamping teeth 29, 39 engage some of the grooves 19.

The respective shape of the clamping teeth and of the grooves allow the half portions 20, 30 to be constrained to the translation in at least a direction away from each other, so as to oppose the forces normally generated during the bending operation.

Figure 9:
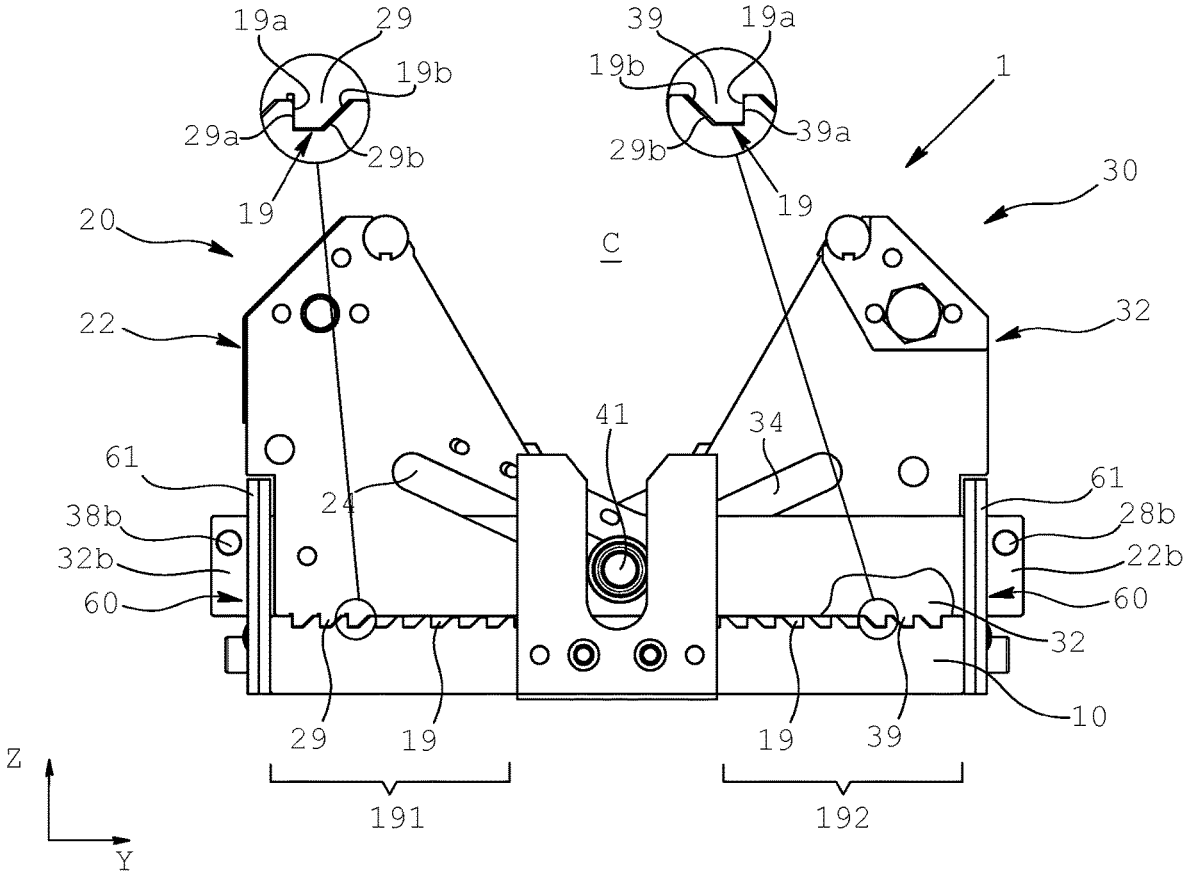
FIG. 9 is a front view of the die of FIG. 8.

For example, the grooves 19 and the clamping teeth 29, 39 have flat gauge surfaces 19*a*, 29*a*, 39*a* arranged perpendicular to the upper 13 and lower 23, 33 surfaces respectively of the base 10 and of the half portions 20, 30 (FIG. 9).

Said gauge surfaces 29*a*, 39*a* of the clamping teeth, in the condition of use of the die, i.e., during bending, are thrust against the respective gauge surfaces 19*a* of the grooves 19.

According to a preferred embodiment, at least the clamping teeth 29, 39, and preferably also the grooves 19, have inclined lateral surfaces 19*b*, 29*b*, 39*b*, opposite the gauge surfaces, which facilitate insertion of said clamping teeth in said grooves.

In the example in FIG. 9, the base comprises a first array of grooves 191 and a second array 192 intended to respectively receive the clamping teeth 29 of the first half portion 20 and the clamping teeth 39 of the second half portion 30.

The gauge surfaces 19*a* and the inclined lateral surfaces 19*b* of the arrays 191 and 192 are therefore substantially symmetrical.

According to the invention, the distance, i.e. the pitch, between the clamping teeth 29, 39 is constant and is substantially equal to the distance between the grooves 19, to allow the insertion of several clamping teeth in the same number of grooves.

The number of grooves 19 of each array 191, 192 is generally greater by at least one unit with respect to the number of clamping teeth 29, 39. In this way, the clamping device allows at least two opening positions of the die. Preferably the grooves are greater in number so as to allow two, three or more opening positions.

Figure 10A:
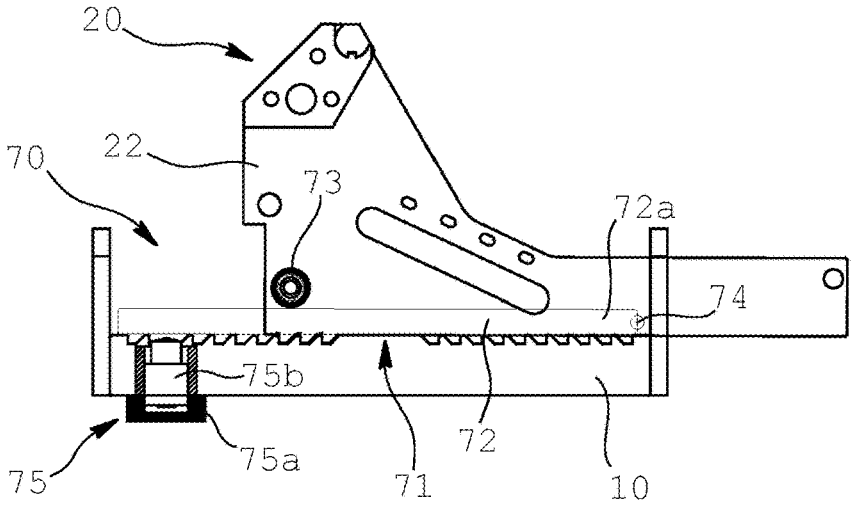
FIGS. 10*a* to 10*c* are sectional front views of the die of FIG. 8.
Figure 10B:
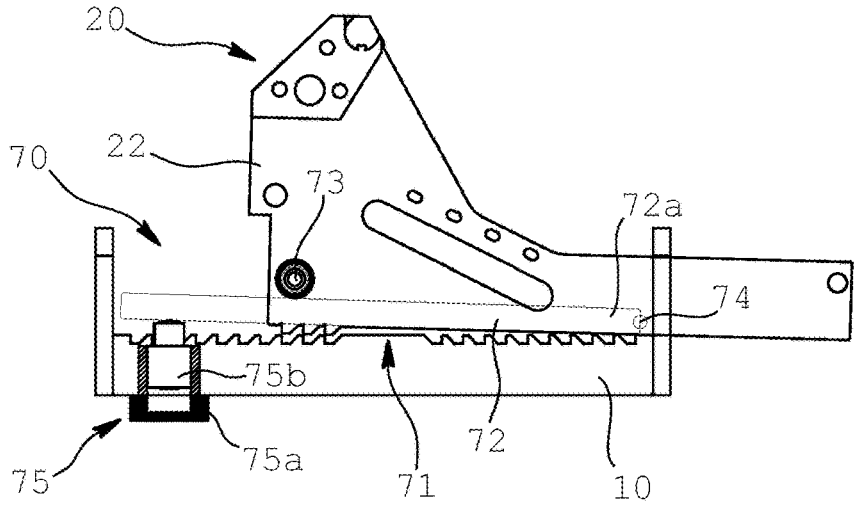
Figure 10C:
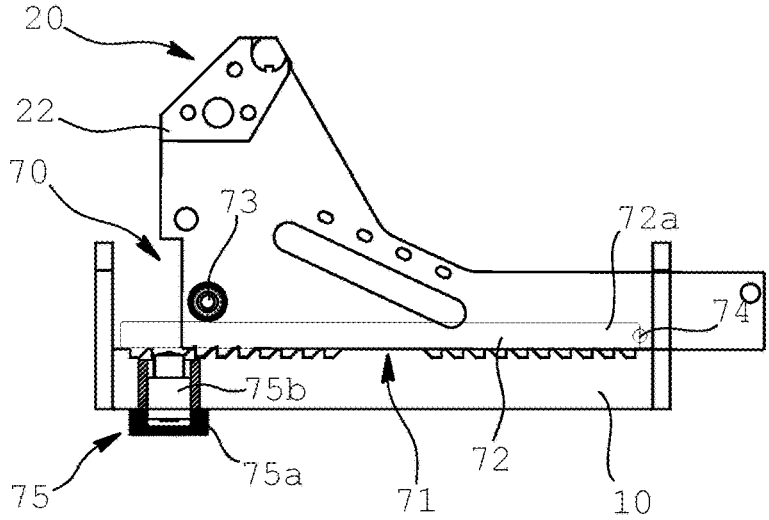

According to the invention, the clamping system also comprises a lifting system, indicated as a whole with 70 in the FIGS. 10*a* to 10*c*, adapted to lift the half portion 20 and the half portion 30 to disengage the clamping teeth 29, 39 from the grooves 19 and thus allow the movement of said half portions away from and toward different clamping positions.

In detail, the lifting system comprises a joint 71 interposed between consecutive and adjacent plates 22, 32 of the first half portion 20 and of the second half portion 30. This positioning of the joint 71 makes it possible to limit the dimensions both of the base 10, and of the die as a whole.

According to a preferred embodiment, said joint 71 comprises at least one rocking guide 72 and at least one gauge 73 integral with at least one plate 22, 32. Advantageously, the rocking guide 72 is hinged in a point, preferably at one end 72*a*, to one or both the aforesaid consecutive plates 22, 32. In this way, the rocking guide 72 can oscillate from an idle position (FIGS. 10*a*, 10*c*), in which it does not engage the half portion 20, 30, to a raised position (FIG. 10*b*), in which it engages the gauge 73 so as to lift the half portion and disengage the clamping teeth 29, 39 from the grooves 19.

Preferably, the gauge 73 comprises a rolling or sliding means, such as a sliding bearing or the like, which reduces the friction with the rocking guide and facilitates translation of the half portions with respect to the base 10.

The arrangement of the rocking guide 72, in particular of the hinge point 74, and of the gauge 73 illustrated in the figures must be considered as a possible example of embodiment.

As a function of the position of the clamping teeth, of their shape and of their size, this arrangement of the rocking guide 72 and of the gauge 73 could vary with respect to the configuration illustrated in FIGS. 10*a*-10*c*.

According to the invention, the oscillation of the rocking guide is controlled by an actuator 75 mounted on the base 10. Said actuator comprises a body 75*a* embedded in the base 10, under the upper surface 13 of this latter, and an active moving part 75*b* that projects beyond said surface to contact the rocking guide 72. The upward thrust of the actuator 75 generates the rotation/oscillation of the rocking guide 72 between the idle position and the lifting position.

The actuator 75 is preferably a pneumatic actuator or, alternatively, a hydraulic actuator, an electric linear actuator, an electromagnetic actuator, or equivalent devices.

It is specified that, for clarity of representation, in the aforesaid FIGS. 10*a*-10*c* only the half portion 20 is illustrated. The arrangement of the lifting system of the opposite half portion 30 is substantially symmetrical to the one represented.

According to the invention, the die 1 is provided with constraining means 60 adapted to prevent vertical movements of the half portions 20, 30 with respect to the base 10, for example rotations. In fact, during bending the force of the punch that is exerted by the metal plate on each half portion 20, 30, has a vertical component and a substantially horizontal component. This horizontal force component, which increases as the bending angle decreases, tends to incline the portions 20, 30 lifting them partially with respect to the base. Said constraining means are adapted to prevent this phenomenon, even in the case of very high bending forces of the punch.

According to a preferred variant of the invention, said constraining means 60 comprise a pair of brackets 61 constrained at the lateral edges of the base 10. Each bracket 61 engages the end part 22*b*, 32*b* of one or more plates 22, 32 to maintain it substantially resting on the upper surface 13 of the base 10.

Preferably, said brackets 61 comprise a sheet, substantially flat, permanently or only temporarily fixed to the base 10, for example by means of screws 63 or the like. Said sheet is in a position substantially perpendicular to the upper surface of the base 10, i.e., in a substantially vertical position. Said sheet has a plurality of openings 62 through which the end parts 22*b*, 32*b* of the first and second plates 22, 32 can slide. Preferably, said openings 62 have a width substantially equal to that of the ends parts 22*b*, 32*b*. In this way, when the die 1 is in use, the end portions 22*b*, 32*b* can slide in the openings 62 but are maintained clamped vertically by an abutting edge 62*a* that slidingly engages the upper sides 26, 36 of said end portions.

The brackets 61 can be made in one piece or in several parts connected independently to the base 10. Each part can comprise one or more openings 62.

According to another variant, not illustrated, the sheet comprises an arch-shaped element, defining a single opening that extends substantially for the whole of the length of the half portion 20, 30. A single continuous abutting edge is in contact with the upper sides 26, 36 of the end portions 22*b*, 32*b*.

Figure 8:
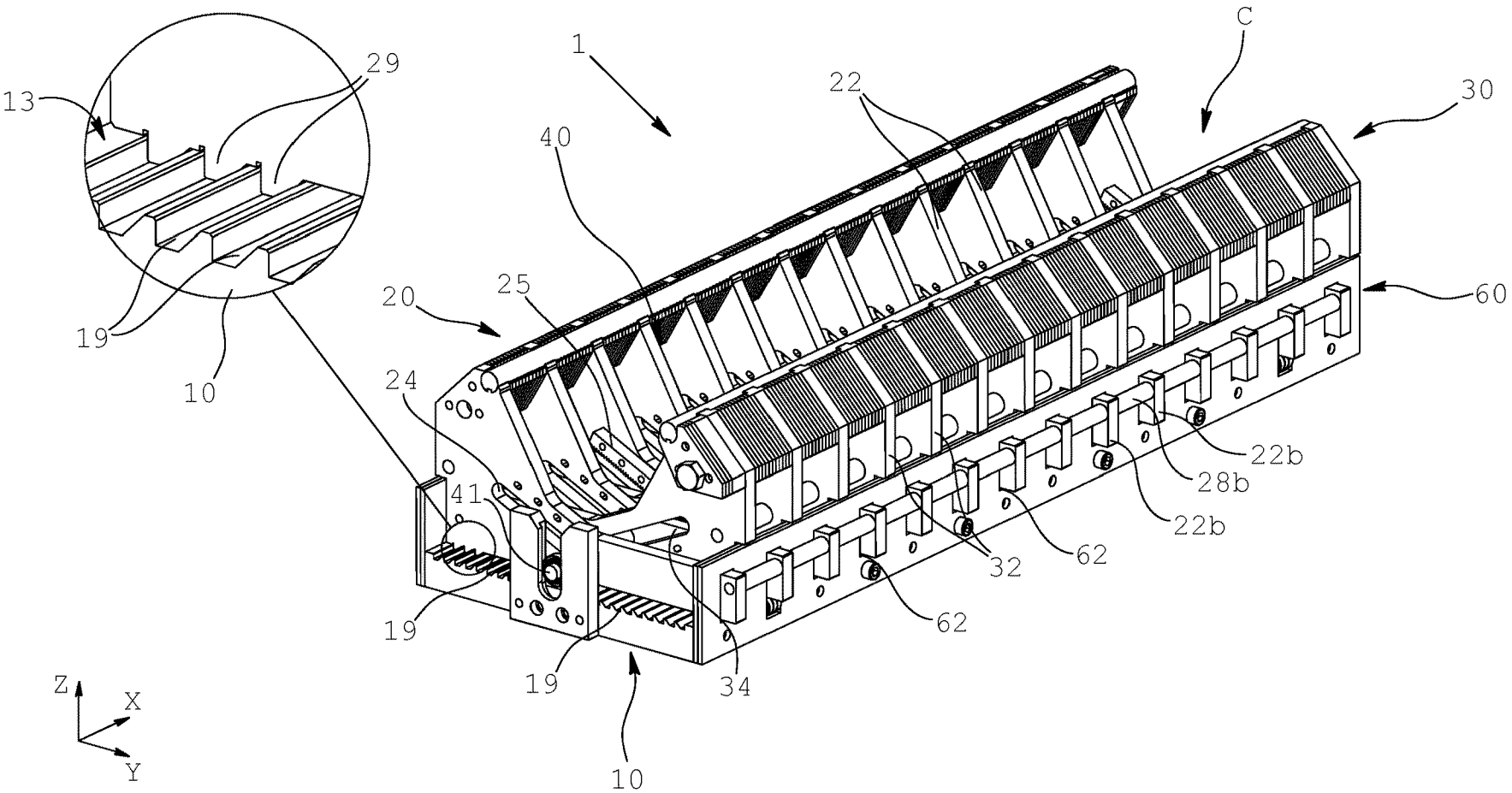
FIG. 8 is a perspective view of the die according to another variant of the invention.

According to a preferred variant, illustrated in FIG. 8, spacers 28*b*, 38*b* are interposed between the end portions 22*b* and 32*b* of the plates 22, 32, to limit any bending of the plates and help to maintain them perfectly parallel to one another.

The invention has been described purely for illustrative and non-limiting purposes, according to some preferred embodiments. Those skilled in the art may find numerous other embodiments and variants, all falling within the scope of protection of the claims below.

The invention claimed is:

1. A die for a press brake comprising:

a base;

a first half portion and a second half portion of a mold, resting sliding on said base, between which the mold cavity is defined, the first half portion comprising a plurality of first plates parallel to one another, the second half portion comprising a plurality of second plates parallel to one another, said first and second plates extending in a transverse direction of the die and being alternated in a longitudinal direction (X) of the die, said first plates being disposed at a distance from one another to accommodate, between two consecutive first plates, at least a part of one of the second plates, said second plates being disposed at a distance from one another to accommodate, between two consecutive second plates, at least a part of one of the first plates; and a translation device configured to move the first half portion and the second half portion away from and toward each other, to vary the width of the mold cavity, said translation device comprising:

a plurality of first guides defined within the first plates and a plurality of second guides defined within the second plates, a shaft disposed along the longitudinal direction of the die and engaged with the first guides and the second guides to slide along said first guides and said second guides when the first half portion and the second half portion are moved away from or toward each other, at least a first pinion and a second pinion mounted on said shaft, at least a first rack and at least a second rack respectively on a first plate and a second plate, said first and second racks being meshed respectively with said first and second pinions so that following rotation of the shaft in one direction or in the opposite direction, the two half portions are moved away from or toward each other.

2. The die according to claim 1, wherein said first guides and said second guides comprise slots disposed respectively in the first plates and in the second plates, in which the shaft is configured to slide freely.

3. The die according to claim 1, wherein sliding directions of the shaft, respectively in the first guides and in the second guides, are inclined and mutually convergent.

4. The die according to claim 3, wherein said sliding directions delimit between the sliding directions an angle from 100° to 130°.

5. The die according to claim 3, wherein the first rack and the second rack are disposed substantially parallel to said sliding directions of the first guides and of the second guides, respectively.

6. The die according to claim 2, wherein the first rack and the second rack are disposed at opposite edges of one of the slots respectively of one of the first guides and one of the second guides.

7. The die according to claim 1, further comprising a guide configured to guide said shaft along a direction substantially perpendicular to a direction of sliding of the first and second half portions of the mold on the base.

8. The die according to claim 1, further comprising a clamp system configured to clamp the first half portion and the second half portion in at least a specific opening position, said clamp system comprising at least one seat configured to house a clamping rod that extends along the longitudinal direction of the die, said seat comprising at least a lower portion in the base and upper portions in the first plates and the second plates, said lower portion and said upper portions configured to be substantially aligned with each other in at least a specific opening position of the two half portions to form said seat in which the clamping rod is accommodated.

9. The die according to claim 8, further comprising a plurality of upper portions of the at least one seat in each of the first plates and a plurality of upper portions of the at least one seat in each of the second plates, so as to define a plurality of seats configured to house the clamping rod in different specific opening positions of the two half portions of the mold.

10. The die according to claim 8, wherein said clamping rod comprises a profile provided with a plurality of transverse notches in the upper part, said notches being disposed in series with a pitch equal to substantially half the distance between one or more of (i) one of the first plates and (ii) one of the second plates and an adjacent plate and having a width at least equal to the thickness of said one or more of the first plate and said second plate.

11. The die according to claim 1, further comprising a constraint system configured to prevent vertical movements of the first and second half portions with respect to the base, said constraint system comprising at least a pair of brackets, that are constrained to the base, each of the brackets is configured to engage an end part of one or more plates of one of the first and second half portions and to maintain the one or more plates substantially resting on the base.

12. The die according to claim 11, wherein said brackets comprise sheets disposed at the respective lateral edges of the base, said sheets having a plurality of openings having a width substantially equal to that of the end part of the plates, said openings having an abutting edge configured to slidingly engage an upper side of said end part.

13. The die according to claim 1, further comprising a blocking system configured to block the first half portion and the second half portion in at least one defined open position, said blocking system comprising:

a plurality of grooves defined in the upper surface of the base and one or more blocking teeth on the lower surface of one or more of the first plates and the second plates, each of the one or more blocking teeth being configured to engage with one of the grooves when the lower surface of the respective first and second half portions is resting on the upper surface of the base, and a lifter configured to raise the first and second half portions to disengage the one or more blocking teeth from the grooves so that the first and second half portions are moved mutually closer together or further apart.

14. The die according to claim 13, wherein the lifter comprises an articulation joint disposed between two consecutive plates of the first half portion and the second half portion.

15. The die according to claim 14, wherein said articulation joint comprises at least one rocking guide configured to oscillate between a non-operational position in which the at least one rocking guide does not engage the first half portion and the second half portion, and a raised position in which the at least one rocking guide engages a gauge in one piece with at least one of the plates of the respective one of the first half portion and the second half portion to raise the respective one of the first half portion and the second half portion.

16. The die according to claim 15, wherein said rocking guide is hinged to at least one of the plates of the respective one of the first half portion and the second half portion.

17. The die according to claim 15, wherein said gauge comprises a roller or slider.

18. The die according to claim 15, further comprising an actuator configured to move the rocking guide, to which the actuator is connected, between the rest position and the raised position.

19. The die according to claim 18, wherein said actuator is housed in the base, the actuator comprising an active moving part protruding from the upper surface of the base towards the rocking guide.

20. The die according to claim 2, wherein sliding directions of the shaft, respectively in the first guides and in the second guides, are inclined and mutually convergent.

* * * * *